US011322835B2

(12) United States Patent
Flores-Cuadras

(10) Patent No.: US 11,322,835 B2
(45) Date of Patent: May 3, 2022

(54) ANTENNA SYSTEM WITH INDEPENDENT GROUND PLANES

(71) Applicant: 2J ANTENNAS USA, CORPORATION, Chandler, AZ (US)

(72) Inventor: Javier Ruben Flores-Cuadras, Chandler, AZ (US)

(73) Assignee: 2J ANTENNAS USA, CORPORATION, Gilbert, AZ (US)

( * ) Notice: Subject to any disclaimer, the term of this patent is extended or adjusted under 35 U.S.C. 154(b) by 30 days.

(21) Appl. No.: 17/004,424

(22) Filed: Aug. 27, 2020

(65) Prior Publication Data

US 2021/0066795 A1 Mar. 4, 2021

Related U.S. Application Data

(60) Provisional application No. 62/892,371, filed on Aug. 27, 2019.

(51) Int. Cl.

| | |
|---|---|
| ***H01Q 1/52*** | (2006.01) |
| ***H01Q 9/16*** | (2006.01) |
| ***H01Q 9/04*** | (2006.01) |
| ***H01Q 1/48*** | (2006.01) |

(52) U.S. Cl.

CPC ..... *H01Q 1/521* (2013.01); *H01Q 1/48* (2013.01); *H01Q 9/0407* (2013.01); *H01Q 9/16* (2013.01)

(58) Field of Classification Search

CPC ..... H01Q 1/521; H01Q 9/0407; H01Q 9/16; H01Q 5/335; H01Q 5/40; H01Q 5/48; H01Q 21/28

See application file for complete search history.

(56) References Cited

U.S. PATENT DOCUMENTS

| | | | | |
|---|---|---|---|---|
| 2013/0321231 | A1* | 12/2013 | Flores-Cuadras | H01Q 5/371 343/793 |
| 2014/0043191 | A1* | 2/2014 | Flores-Cuadras | H01Q 9/40 343/700 MS |
| 2018/0062731 | A1* | 3/2018 | Ng | H01Q 5/50 |
| 2018/0309204 | A1* | 10/2018 | Ng | H01Q 5/30 |
| 2021/0066795 | A1* | 3/2021 | Flores-Cuadras | H01Q 1/48 |
| 2021/0194128 | A1* | 6/2021 | Ma | H01Q 1/2258 |

* cited by examiner

*Primary Examiner* — Jason Crawford

(74) *Attorney, Agent, or Firm* — CP Law Group PC; Cy Bates

(57) ABSTRACT

An antenna system including a first antenna portion having a first antenna element and a second antenna portion having a second antenna element. The first antenna portion is physically separated from the second antenna portion and the second antenna element is configured as a mirror opposite of the first antenna element. In addition, the first antenna portion is configured within a common plane with the second antenna portion. In various embodiments, an antenna system is disclosed that is optimized for high isolation in a small form factor using independent ground planes.

14 Claims, 5 Drawing Sheets

ANTENNA SYSTEM WITH INDEPENDENT GROUND PLANES

CROSS-REFERENCE TO RELATED APPLICATIONS

This application claims benefit of priority with U.S. Provisional Application Ser. No. 62/892,371, filed Aug. 27, 2019; the entire contents of which are hereby incorporated by reference.

BACKGROUND

Field of the Invention

This invention relates to antennas; more particularly, to a Multiple-Input Multiple-Output (MIMO) antenna system configured for improved performance for wide band 5G NR frequencies (ex: 600 MHz to 6000 MHz), including separate ground planes and mirrored antenna element configurations.

Description of the Related Art

Multiple-Input Multiple-Output (MIMO) antennas are used to enhance the data throughput and the signal-to-noise ratio of communication systems. For many applications, such as cellular or internet of things (IOT), a smaller form factor of the MIMO antenna array is desirable. However, there is a challenge that when dimensions are decreased, isolation of the antennas is negatively impacted in the MIMO array, which adversely affects the antenna performance. It would be beneficial in the art if the size of the MIMO antenna could be reduced while improving correlation and isolation of the antenna system in the compact space.

SUMMARY

The disclosure concerns an antenna system with a first antenna portion including a first antenna element and a second antenna portion including a second antenna element. The first antenna portion is physically separated from the second antenna portion and the second antenna element is configured as a mirror opposite of the first antenna element. In addition, the first antenna portion is configured within a common plane with the second antenna portion. A cable is used to connect the antenna system to a transceiver or radio circuit.

Other advantages and benefits are further described in the appended detailed descriptions.

BRIEF DESCRIPTION OF THE DRAWINGS

Other features, combinations, and embodiments will be appreciated by one having the ordinary level of skill in the art of antennas and accessories upon a thorough review of the following details and descriptions, particularly when reviewed in conjunction with the drawings, wherein.

DETAILED DESCRIPTION

Figure 1:
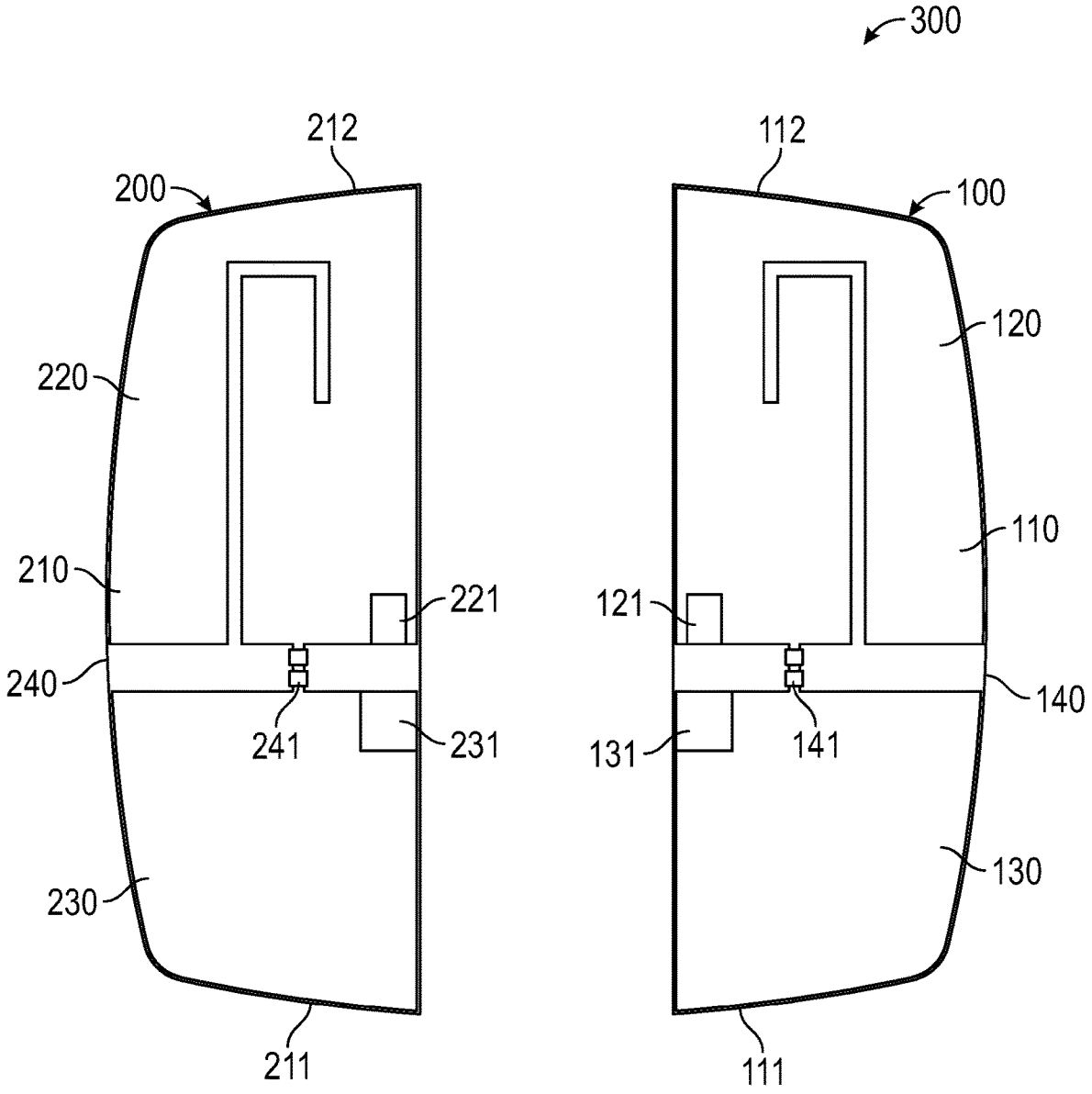
FIG. 1 shows a top view of the antenna system in accordance with a first embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, and a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

GENERAL DESCRIPTION OF EMBODIMENTS

In a first embodiment, an antenna system is disclosed, the antenna system comprises a first antenna portion, the first antenna portion comprises a first substrate extending from a first proximal end to a first distal end, a first antenna element coupled to the first substrate at the first distal end, a first ground plane coupled to the first substrate at the first proximal end, a first gap disposed between the first antenna element and the first ground plane, a first feed pad coupled to the first antenna element, and a first ground pad coupled to the first ground plane. The antenna system further comprises a second antenna portion, the second antenna portion comprises a second substrate extending from a second proximal end to a second distal end, a second antenna element coupled to the second substrate at the second distal end, a second ground plane coupled to the second substrate at the second proximal end, a second gap disposed between the second antenna element and the second ground plane, a second feed pad coupled to the second antenna element, and a second ground pad coupled to the second ground plane. The first and second antenna portions and their respective subcomponents are characterized in that the first antenna portion is physically separated from the second antenna portion and the second antenna element is a mirror opposite of the first antenna element. Lastly, the first antenna portion is configured within a common plane with the second antenna portion.

In some embodiments, the antenna system comprises first surface mount device (SMD) pads disposed between the first antenna element and the first ground plane at the first gap, and second surface mount device (SMD) pads disposed between the second antenna element and the second ground plane at the second gap.

In the first embodiment, the antenna system may further comprise a first coaxial cable. The first coaxial cable includes a first feed conductor coupled to the first feed pad, a first insulator concentrically surrounding the first feed conductor, and a first outer conductor surrounding the first insulator and the first feed conductor therein. The first outer conductor is coupled to the first ground pad, and a first jacket surrounding each of the first outer conductor, the first insulator, and the first feed conductor.

In the first embodiment, the antenna system may further comprise a second coaxial cable. The second coaxial cable includes a second feed conductor coupled to the second feed pad, a second insulator concentrically surrounding the second feed conductor, a second outer conductor surrounding the second insulator and the second feed conductor therein. The second outer conductor is coupled to the second ground pad, and a second jacket surrounding each of the second outer conductor, the second insulator, and the second feed conductor.

In some embodiments, the antenna system may further comprise a patch antenna assembly, wherein the patch antenna assembly is disposed between the first and second antenna portions.

In the first embodiment, each of the first and second antenna elements may independently comprise a dipole.

In the some embodiments, the antenna system may further comprise a resistor coupled between the SMD pads.

Generally, the first antenna element may electrically be isolated from the second antenna element of the first antenna portion and/or the second antenna portion.

In a second embodiment, an antenna system is disclosed. The antenna system comprises a first antenna portion and a second antenna portion. The first antenna portion includes a first substrate which extends from a first proximal end to a first distal end of the first antenna portion. A first antenna element is coupled to the first substrate at the first distal end, a first ground plane is coupled to the first substrate at the first proximal end, and a first gap is disposed between the first antenna element and the first ground plane. First surface mount device (SMD) pads are disposed between the first antenna element and the first ground plane at the first gap. In addition, the first antenna portion includes a first feed pad coupled to the first antenna element, a first ground pad coupled to the first ground plane, and a first coaxial cable. The first coaxial cable comprises a first feed conductor coupled to the first feed pad, a first insulator concentrically surrounds the first feed conductor, and a first outer conductor surrounds the first insulator and the first feed conductor therein. The first outer conductor is coupled to the first ground pad, and a first jacket surrounds each of the first outer conductor, the first insulator, and the first feed conductor, respectively. The second antenna portion includes a second substrate that extends from a second proximal end to a second distal end of the second antenna portion. A second antenna element is coupled to the second substrate at the second distal end, a second ground plane is coupled to the second substrate at the second proximal end, and a second gap is disposed between the second antenna element and the second ground plane. second surface mount device (SMD) pads are disposed between the second antenna element and the second ground plane at the second gap. In addition, the second antenna portion includes a second feed pad coupled to the second antenna element, a second ground pad coupled to the second ground plane, and a second coaxial cable. The second coaxial cable comprises a second feed conductor coupled to the second feed pad, a second insulator concentrically surrounds the second feed conductor, and a second outer conductor surrounds the second insulator and the second feed conductor therein. The second outer conductor is coupled to the second ground pad, and a second jacket surrounds each of the second outer conductor, the second insulator, and the second feed conductor, respectively. The first antenna portion is physically separated from the second antenna portion and the second antenna element is a mirror opposite of the first antenna element. The first antenna portion is configured within a common plane with the second antenna portion.

In the second embodiment, the first and second antenna elements may independently comprise of dipole antennas.

In the second embodiment, the antenna system may further comprise a resistor coupled to the SMD pads.

In the second embodiment, the antenna system may be characterized as the first antenna element is electrically isolated from the second antenna element.

In a third embodiment, an antenna system is disclosed. The antenna system comprises a first antenna portion including a first antenna element and a second antenna portion including a second antenna element. The first antenna portion is physically separated from the second antenna portion, and the second antenna element is configured as a mirror opposite of the first antenna element. The first antenna portion is configured within a common plane with the second antenna portion.

A function of the antenna system is to maintain a low correlation and high isolation between two antennas while also compressing them closer together to achieve a smaller form factor without sacrificing antenna performance. The invention is further differentiated by using a novel configuration that includes mirrored antenna elements in addition to coplanar ground substrates that are electrically and mechanically independent from each.

Manufacturing

Generally, the ground plane is made of industry standard material such as FR4, Kapton or Pyralux with printed circuit design affixed thereto. Otherwise, the ground plane can be fabricated in accordance with the level and knowledge of one having skill in the art. Other examples without limitation include more specialized materials such as Duroid, Taconic, and LDS.

The transmission line is made from coaxial cable which may be obtained commercially, for example and without limitation, ACX1589-ND on Digi-Key (https://www.digikey.com/product-detail/en/amphenol-rf/135103-02-12-00/ACX1589-ND/2003922). Alternatively, the transmission line can be customized in accordance with the level and knowledge of one having skill in the art. The transmission line includes connectors for the purpose of coupling the radio with the antenna element. The connections can be any combinations of SMA, W.FL., U.FL or any other connections known in the art. Furthermore, each connection can be either Male or Female depending on both the radio and antenna element that the transmission line would couple.

The antenna radiator may be fabricated by etching the antenna element pattern in a metal trace bonded to an insulating dielectric substrate, such as a printed circuit board.

Each of the components of the antenna system described herein may be manufactured and/or assembled in accordance with the conventional knowledge and level of a person having skill in the art.

Definitions

For purposes herein the term "antenna" means a device used to transmit or receive electromagnetic waves.

The term "substrate" means a flat or nearly flat surface that contains a conducting portion and is part of the antenna.

The term "coaxial cable" means a type of electrical cable that are commonly used as transmission lines in antenna design.

The term "SMD" or "surface mount device" refers to an electrical component that is mounted directly onto the surface of a printed circuit board, generally by soldering.

The term "asymmetric" means having parts or aspects that are not equal in some respect.

The term "mirror" means an object that is identical in form to another, but with the structure reversed.

First Illustrated Embodiment

Now turning to the drawings, FIG. 1 shows a top view of an antenna system (300) according to a first illustrated embodiment. The antenna system comprises a first antenna portion (100) and a second antenna portion (200). The first antenna portion comprises a first substrate (110) and the second antenna portion comprises a second substrate (210). The first and second substrates are physically separated from each other to allow a first ground plane (130) and a second ground plane (230) to be independent from each other. The first ground plane is coupled to a first proximal end (111) of the first substrate, and the second ground plane is coupled to a second proximal end (211) of the second substrate. The first substrate further comprises a first antenna element (120) coupled to a first distal end (112). Additionally, the second substrate also further comprises a second antenna element (220) coupled to a second distal end (212). A first gap (140) is disposed between the first antenna element and the first ground plane. A first feed pad (121) is coupled to the first antenna element and is disposed near the first gap. A first ground pad (131) is coupled to the first ground plane and is also disposed near the first gap. A second gap (240) is disposed between the second antenna element and the second ground plane. A second feed pad (221) is coupled to the second antenna element and is disposed near the second gap. A second ground pad (231) is coupled to the second ground plane and is also disposed near the second gap. Lastly, both the first gap and second gap include first surface mount pads (141) and second surface mount pads (241), respectively. The first and second antenna elements can be observed by one having skill in the art to be in an asymmetric formation. They may further be described as being mirror images of each other. The first substrate and second substrate can be characterized as being coplanar with one another.

Second Illustrated Embodiment

Figure 2:
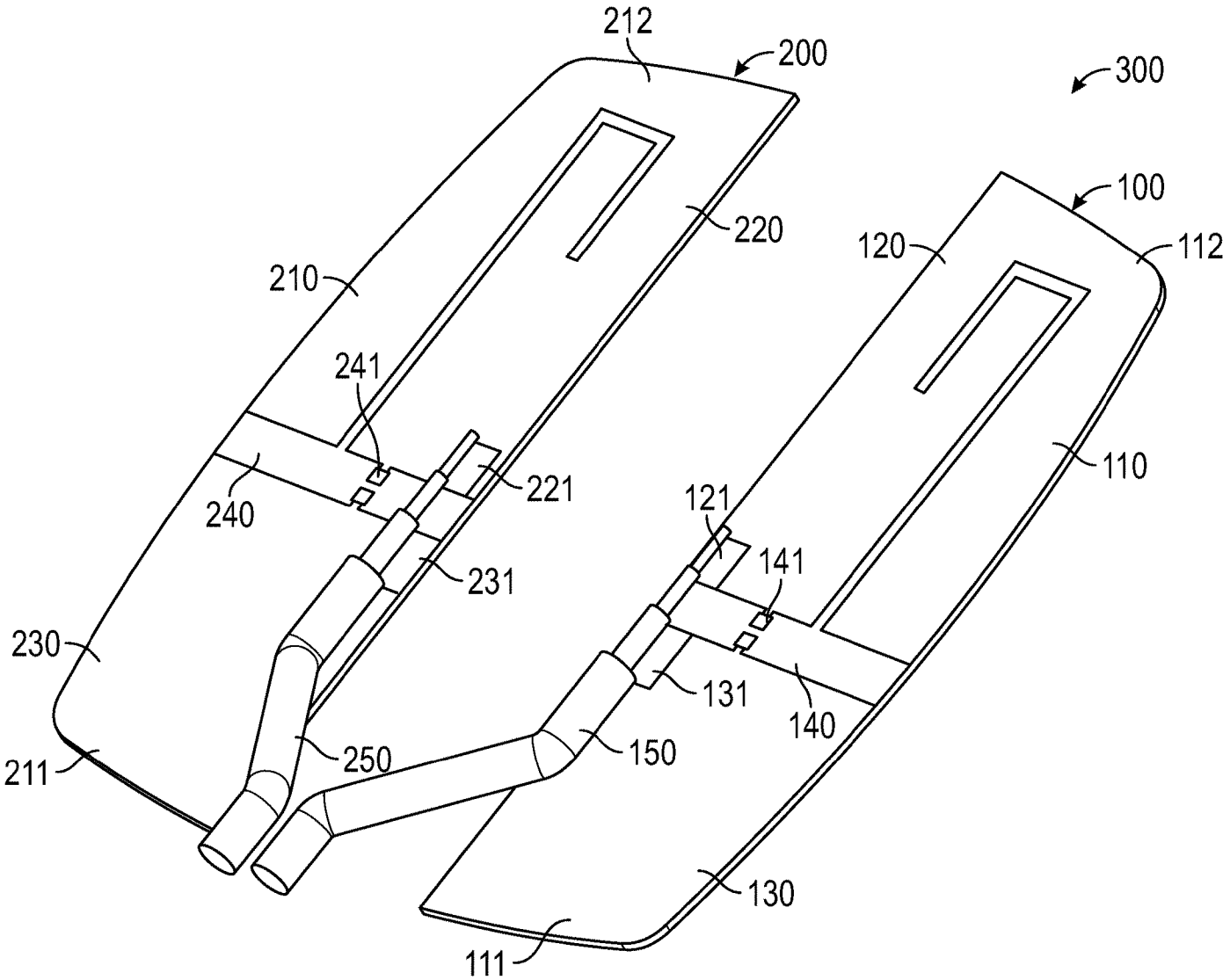
FIG. 2 shows an isometric view of the antenna system in accordance with a second embodiment.

FIG. 2 shows an isometric view of antenna system (300) in accordance with a second embodiment. The antenna system comprises a first antenna portion (100), a second antenna portion (200), a first coaxial cable (150) and a second coaxial cable (250). The first antenna portion includes a first substrate (110) which has a first proximal end (111) and a first distal end (112). At the first proximal end is coupled a first ground plane (130), and at the first distal end is coupled a first antenna element (120). In between the first ground plane and first antenna element is disposed a first gap (140), the first gap further including a first surface mount pad (141). The first ground plane further includes a first ground pad (131) and the first antenna element further includes a first feed pad (121). The first coaxial cable is coupled to the first antenna portion at the first feed pad and the first ground pad. The second antenna portion includes a second substrate (210) which has a second proximal end (211) and a second distal end (212). At the second proximal end is coupled a second ground plane (230), and at the second distal end is coupled a second antenna element (220). In between the second ground plane and second antenna element is disposed a second gap (240), the second gap further including a second surface mount pad (241). The second ground plane further includes a second ground pad (231) and the second antenna element further includes a second feed pad (221). The second coaxial cable is coupled to the second antenna portion at the second feed pad and the second ground pad. The first antenna element and second antenna element are asymmetric to each other, and may each be, for example and without limitation, a dipole antenna. Furthermore, the first and second substrates share a common plane are physically separated from each other to each, among other things, ground independence between the first ground plane and the second ground plane.

Figure 3:
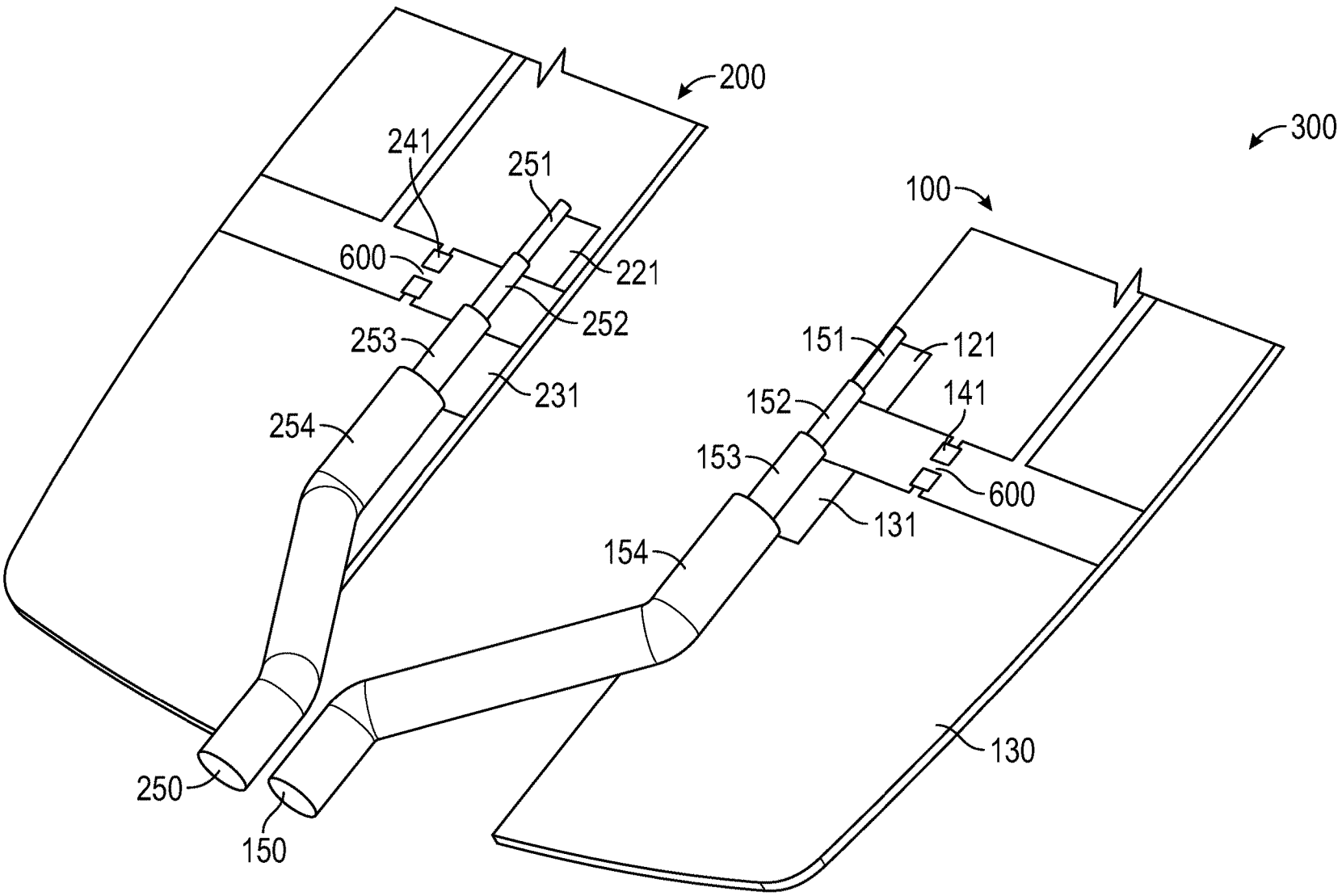
FIG. 3 shows an isometric view of a focused of the antenna system in accordance with the second embodiment, namely relating to the first and second coaxial cables.

FIG. 3 shows an alternative view from FIG. 2 of an antenna system (300) in accordance with the second embodiment. In this illustration, a first coaxial cable (150) and second coaxial cable (250) are shown in greater detail relative to FIG. 2. The first coaxial cable comprises a first feed connector (151), the first feed connector coupled to a first feed pad (132) of a first antenna portion (100). Surrounding the first feed connector is a first insulator (152), the first insulator itself surround by a first outer conductor (153). The first outer conductor is coupled to a first ground pad (130) of the first antenna portion. Lastly, a first jacket (154) surrounds the first outer conductor. The second coaxial cable comprises a second feed connector (251), the second feed connector coupled to a second feed pad (232) of a second antenna portion (200). Surrounding the second feed connector is a second insulator (252), the second insulator itself surround by a second outer conductor (253). The second outer conductor is coupled to a second ground pad (230) of the second antenna portion. Lastly, a second jacket (254) surrounds the second outer conductor. The first and second antenna portions are physically separated from each other, and the first and second coaxial cables follow path that traverses of this separated space. On the first antenna portion includes a first surface mount pad (141), and consequently the second antenna portion includes a second surface mount pad (241). Resistors (600) are each individually coupled to the first and second surface mount pad. A purpose for the resistors is to be compatible with an antenna detection system that determines the type of antenna based on the particular resistor that is coupled to it.

In FIG. 3 the coaxial connection between a first feed connector (151) and first feed pad (121), in addition to a first outer conductor (153) and a first ground pad (131) may be utilized with SMD pads or SMD connectors, for exampled and without limitation, U.FL, MCX, MMCX, or UMCX.

Figure 4:
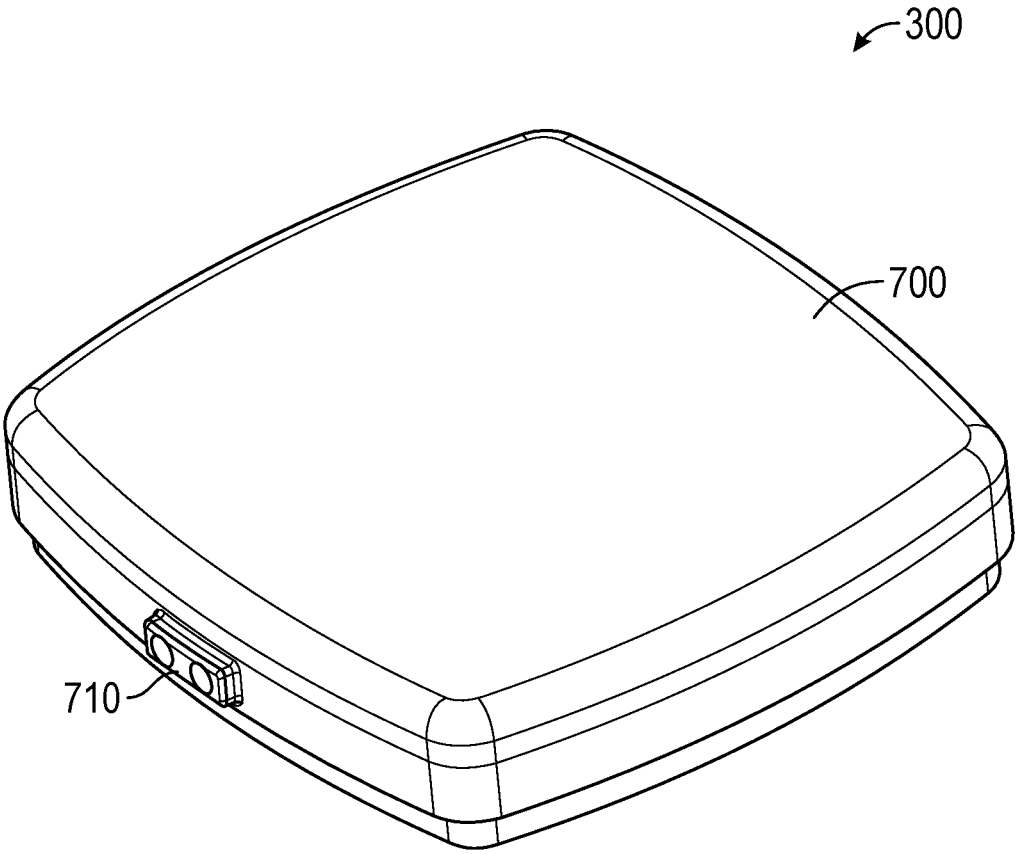
FIG. 4 shows an isometric view of the antenna system contained within a housing in accordance with the second embodiment.

FIG. 4 shows an isometric view of an antenna system (300) contained within a housing (700) in accordance with the second embodiment. The housing includes exit holes (710) that allows for a first coaxial cable (FIG. 3, 150) and a second coaxial cable (FIG. 3, 250) to couple the antenna system with any device outside of the housing.

Figure 5:
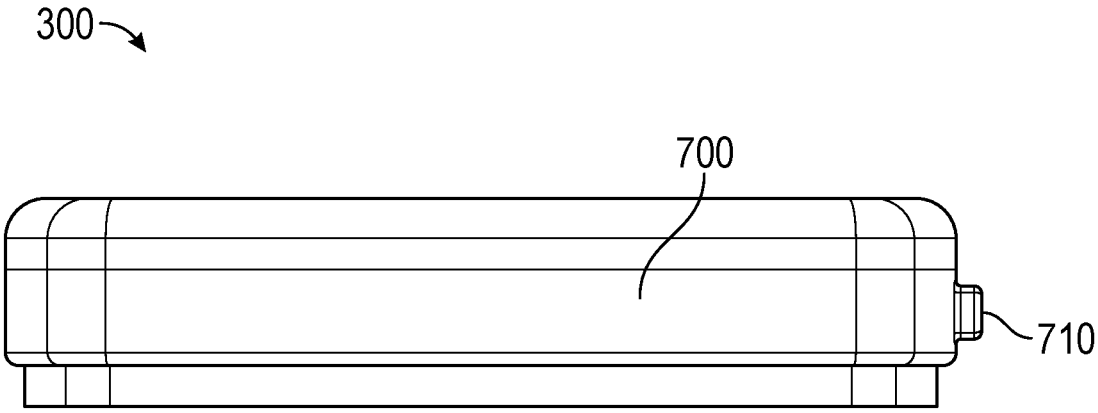
FIG. 5 shows a side view of the antenna system contained within a housing in accordance with the second embodiment.

FIG. 5 shows a side view of an antenna system (300) contained within a housing (700) in accordance with the second embodiment. The housing includes exit holes (710) that allows for a first coaxial cable (FIG. 3, 150) and a second coaxial cable (FIG. 3, 250) to couple the antenna system with any device outside of the housing.

Figure 6:
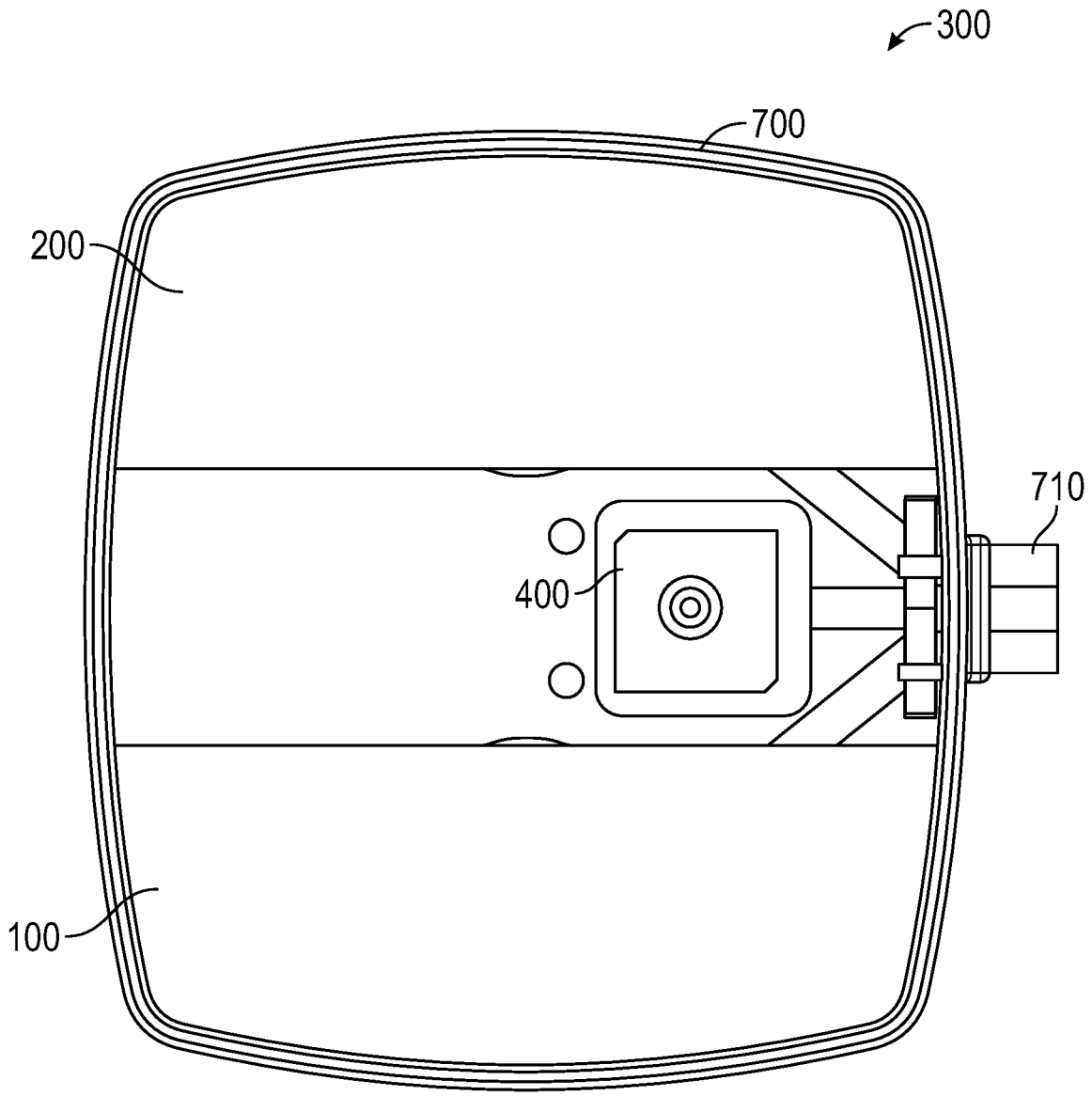
FIG. 6 shows a bottom view of the antenna system contained with a housing and having an option patch antenna in accordance with the second embodiment.

FIG. 6 shows a bottom of an antenna system (300) contained within a housing (700) in accordance with the second embodiment (bottom cover removed). The housing includes exit holes (710) that allows for a first coaxial cable (FIG. 3, 150) and a second coaxial cable (FIG. 3, 250) to couple the antenna system with any device outside of the housing. Furthermore, a patch antenna assembly (400) is coupled to the antenna system within the housing between a first antenna portion (100) and a second antenna portion (200). The patch antenna assembly can be, for example and without limitation, a patch antenna for GNSS wireless communications.

FEATURE LIST antenna system (300)
first antenna portion (100)
first substrate (110)
first proximal end (111)
first distal end (112)
first antenna element (120)
first ground plane (130)
first gap (140)
first surface mount pad (141)
first feed pad (121)
first ground pad (131)
first coaxial cable (150)
first feed conductor (151)
first insulator (152)
first outer conductor (153)
first jacket (154)
second antenna portion (200)
second substrate (210)
second proximal end (211)
second distal end (212)
second antenna element (220)
second ground plane (230)
second gap (240)
second surface mount pad (241)
second feed pad (221)
second ground pad (231)
second coaxial cable (250)
second feed conductor (251)
second insulator (252)
second outer conductor (253)
second jacket (254)
patch antenna assembly (400)
resistor (600)
housing (700)
exit holes (710)

What is claimed is:

1. An antenna system, comprising:
a first antenna portion, the first antenna portion comprising:
a first substrate extending from a first proximal end to a first distal end,
a first antenna element coupled to the first substrate at the first distal end,
a first ground plane coupled to the first substrate at the first proximal end,
a first gap disposed between the first antenna element and the first ground plane,
first surface mount device (SMD) pads disposed between the first antenna element and the first ground plane at the first gap,
a first feed pad coupled to the first antenna element,
a first ground pad coupled to the first ground plane,
a first coaxial cable, the first coaxial cable comprising:
a first feed conductor coupled to the first feed pad,
a first insulator concentrically surrounding the first feed conductor,
a first outer conductor surrounding the first insulator and the first feed conductor therein, the first outer conductor coupled to the first ground pad, and
a first jacket surrounding each of the first outer conductor, the first insulator, and the first feed conductor, respectively;
a second antenna portion, the second antenna portion comprising:
a second substrate extending from a second proximal end to a second distal end,
a second antenna element coupled to the second substrate at the second distal end,
a second ground plane coupled to the second substrate at the second proximal end,
a second gap disposed between the second antenna element and the second ground plane,
second surface mount device (SMD) pads disposed between the second antenna element and the second ground plane at the second gap,
a second feed pad coupled to the second antenna element,
a second ground pad coupled to the second ground plane,
a second coaxial cable, the second coaxial cable comprising:
a second feed conductor coupled to the second feed pad,
a second insulator concentrically surrounding the second feed conductor,
a second outer conductor surrounding the second insulator and the second feed conductor therein, the second outer conductor coupled to the second ground pad, and
a second jacket surrounding each of the second outer conductor, the second insulator, and the second feed conductor, respectively;
characterized in that:
the first antenna portion is physically separated from the second antenna portion,
the second antenna element is a mirror opposite of the first antenna element, and
the first antenna portion is configured within a common plane with the second antenna portion.

2. The antenna system of claim 1, further comprising a patch antenna assembly, wherein the patch antenna assembly is disposed between the first and second antenna portions.

3. The antenna system of claim 1, each of the first and second antenna elements independently comprises a dipole.

4. The antenna system of claim 1, further comprising a resistor coupled to the SMD pads.

5. The antenna system of claim 1, wherein the first antenna element is electrically isolated from the second antenna element.

6. An antenna system, comprising:
a first antenna portion, the first antenna portion comprising:
a first substrate extending from a first proximal end to a first distal end,
a first antenna element coupled to the first substrate at the first distal end,
a first ground plane coupled to the first substrate at the first proximal end,
a first gap disposed between the first antenna element and the first ground plane,
a first feed pad coupled to the first antenna element,
a first ground pad coupled to the first ground plane,
a second antenna portion, the second antenna portion comprising:
a second substrate extending from a second proximal end to a second distal end,
a second antenna element coupled to the second substrate at the second distal end, a second ground plane coupled to the second substrate at the second proximal end, a second gap disposed between the second antenna element and the second ground plane, a second feed pad coupled to the second antenna element, a second ground pad coupled to the second ground plane, characterized in that:

the first antenna portion is physically separated from the second antenna portion, the second antenna element is a mirror opposite of the first antenna element, and the first antenna portion is configured within a common plane with the second antenna portion.

7. The antenna system of claim 6, further comprising first surface mount device (SMD) pads disposed between the first antenna element and the first ground plane at the first gap.

8. The antenna system of claim 6, further comprising second surface mount device (SMD) pads disposed between the second antenna element and the second ground plane at the second gap.

9. The antenna system of claim 6, further comprising a first coaxial cable, the first coaxial cable comprising:

a first feed conductor coupled to the first feed pad, a first insulator concentrically surrounding the first feed conductor, a first outer conductor surrounding the first insulator and the first feed conductor therein, the first outer conductor coupled to the first ground pad, and a first jacket surrounding each of the first outer conductor, the first insulator, and the first feed conductor, respectively.

10. The antenna system of claim 6, further comprising a second coaxial cable, the second coaxial cable comprising:

a second feed conductor coupled to the second feed pad, a second insulator concentrically surrounding the second feed conductor, a second outer conductor surrounding the second insulator and the second feed conductor therein, the second outer conductor coupled to the second ground pad, and a second jacket surrounding each of the second outer conductor, the second insulator, and the second feed conductor, respectively.

11. The antenna system of claim 6, further comprising a patch antenna assembly, wherein the patch antenna assembly is disposed between the first and second antenna portions.

12. The antenna system of claim 6, each of the first and second antenna elements independently comprises a dipole.

13. The antenna system of claim 6, further comprising a resistor coupled to the SMD pads.

14. The antenna system of claim 6, wherein the first antenna element is electrically isolated from the second antenna element.

* * * * *